US005167987A

United States Patent [19]

Yu

[11] Patent Number: 5,167,987

[45] Date of Patent: Dec. 1, 1992

[54] PROCESS FOR FABRICATING ELECTROSTATOGRAPHIC IMAGING MEMBERS

[75] Inventor: Robert C. U. Yu, Webster, N.Y.

[73] Assignee: Xerox Corporation, Stamford, Conn.

[21] Appl. No.: 787,465

[22] Filed: Nov. 4, 1991

[51] Int. Cl.[5] ..... B05D 3/12; G03G 5/00; D02G 3/00; B28B 11/08

[52] U.S. Cl. ..... 427/171; 430/127; 430/130; 430/133; 430/930; 428/910; 427/374.1; 427/393.5; 264/230; 264/291

[58] Field of Search ..... 430/127, 130, 133, 930; 427/374.1, 393.5, 171; 428/910; 264/230, 291

[56] References Cited

U.S. PATENT DOCUMENTS

| | | | |
|---|---|---|---|
| 4,621,009 | 11/1986 | Lax | 428/216 |
| 4,675,233 | 6/1987 | Wakahara et al. | 428/323 |
| 4,942,105 | 7/1990 | Yu | 430/59 |
| 4,983,481 | 1/1991 | Yu | 430/59 |

FOREIGN PATENT DOCUMENTS

| | | | |
|---|---|---|---|
| 1493529 | 11/1977 | United Kingdom | 430/127 |

*Primary Examiner*—Marion E. McCamish
*Assistant Examiner*—S. Crossan
*Attorney, Agent, or Firm*—Peter H. Kondo

[57] ABSTRACT

A process for fabricating an electrostatographic imaging member including providing a flexible substrate comprising a solid thermoplastic polymer, forming an imaging layer coating including a film forming polymer on the substrate, heating the coating and substrate, cooling the coating and substrate, and applying sufficient predetermined biaxial tensions to the substrate while the imaging layer coating and substrate are at a temperature greater than the glass transition temperature of the imaging layer coating to substantially compensate for all dimensional thermal contraction mismatches between the substrate and the imaging layer coating during cooling of the imaging layer coating and the substrate, removing application of the biaxial tension to the substrate, and cooling the substrate whereby the final hardened and cooled imaging layer coating and substrate are substantially free of internal stress and strain.

19 Claims, 1 Drawing Sheet

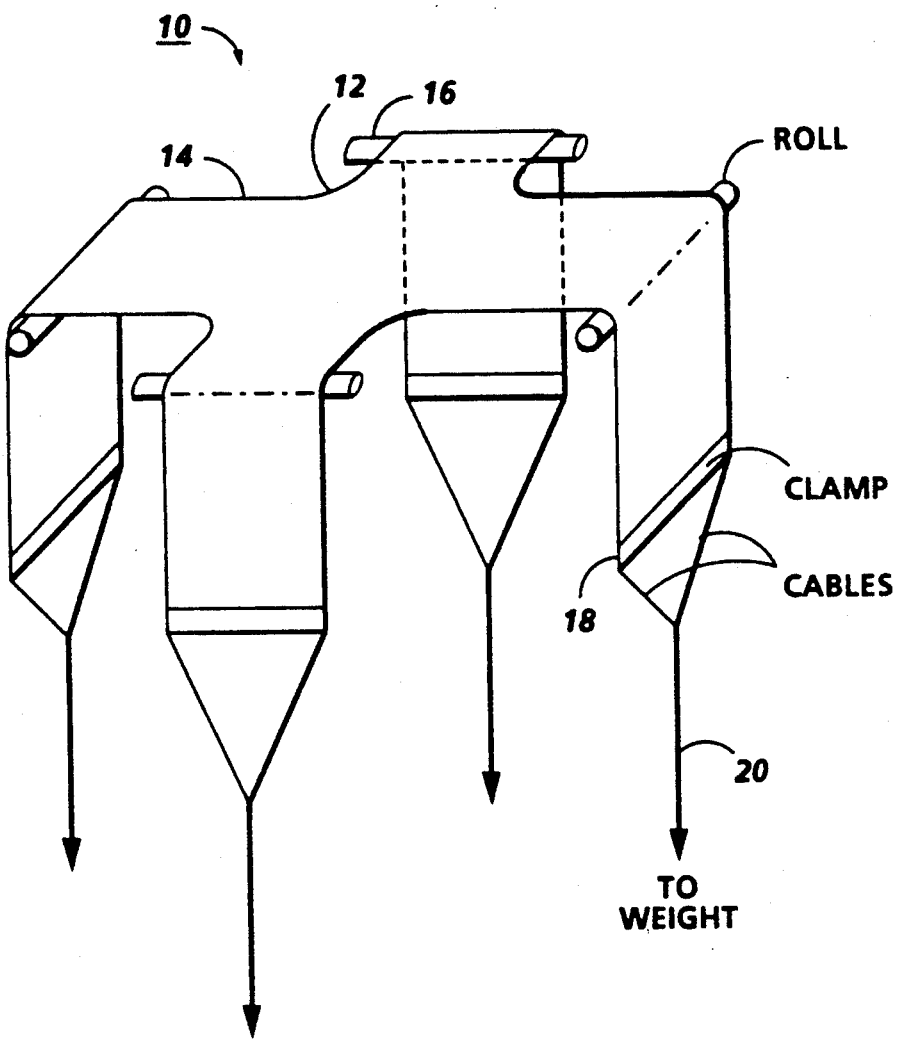
10
12
16
14
ROLL
CLAMP
CABLES
18
20
TO
WEIGHT

PROCESS FOR FABRICATING ELECTROSTATOGRAPHIC IMAGING MEMBERS

BACKGROUND OF THE INVENTION

This invention relates in general to electrostatography and, more specifically, to a process for fabricating electrostatographic imaging members.

In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive materials exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous dispersions of conductive material in binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

When one or more electrically active layers are applied to a flexible supporting substrate, it has been found that the resulting photoconductive member tends to curl. Curling is undesirable because different segments of the imaging surface of the photoconductive member are located at different distances from charging devices, developer applicators and the like during the electrophotographic imaging process thereby adversely affecting the quality of the ultimate developed images. For example, non-uniform charging distances can be manifested as variations in high background deposits during development of electrostatic latent images. A imaging member having a tendency to curl can spontaneously form a roll as small as 3.8 cm in diameter and requires considerable tension to flatten the imaging member against the surface of a separate supporting device. Where the supporting device comprises a large flat area for full frame flash exposure, the imaging member may tear before sufficient flatness can be achieved. Moreover, constant flexing of multilayered photoreceptor belts during cycling can cause stress cracks to form due to fatigue. These cracks print out on the final electrophotographic copy. Premature failure due to fatigue prohibits use of these belts in designs utilizing small roller sizes (e.g. 19 mm or smaller) for effective auto paper stripping. Coatings may be applied to the side of the supporting substrate opposite the electrically active layer or layers to counteract the tendency to curl. However, such coating requires an additional coating step on a side of the substrate opposite from the side where all the other coatings are applied. This additional coating operation normally requires that a substrate web be unrolled an additional time merely to apply the anti-curl layer. Also, many of the solvents utilized to apply the anti-curl layer require additional steps and solvent recovery equipment to minimize solvent pollution of the atmosphere. Further, equipment required to apply the anti-curl coating must be cleaned with solvent and refurbished from time to time. The additional coating operations raise the cost of the photoreceptor, increase manufacturing time, decrease production throughput, and increases the likelihood that the photoreceptor will be damaged by the additional handling. In addition, the anti-curl backing layer can form bubbles during application which requires scrapping of that portion of the photoreceptor containing the bubbles. This in turn reduces total manufacturing yield. Also, difficulties have been encountered with these anti-curl coatings. For example, photoreceptor curl can sometimes still be encountered due to a decrrease in anti-curl layer thickness resulting from wear in as few as 1,500 imaging cycles when the photoreceptor belt is exposed to stressful operating conditions of high temperature and high humidity. The curling of the photoreceptor is inherently caused by internal stress build-up in the electrically active layer or layers of the photoreceptor which promotes dynamic fatigue cracking, thereby shortening the mechanical life of the photoreceptor. Further, the anti-curl coatings occasionally separate from the substrate during extended machine cycling and render the photoconductive imaging member unacceptable for forming quality images. Anti-curl layers will also occasionally delaminate due to poor adhesion to the supporting substrate. Moreover, in electrostatographic imaging systems where transparency of the substrate and anti-curl layer are necessary for rear exposure erase to activating electromagnetic radiation, any reduction of transparency due to the presence of an anti-curl layer will cause a reduction in performance of the photoconductive imaging member. Although the reduction in transparency may in some cases be compensated by increasing the intensity of the electromagnetic radiation, such increase is generally undesirable due to the amount of heat generated as well as the greater costs necessary to achieve higher intensity.

Curling of a photoreceptor can be prevented by careful selection of a supporting layer which has a thermal contraction coefficient substantially identical to the thermal contraction coefficient of the charge transport layer. However, such combination limits the choice of materials that can be used for imaging members.

INFORMATION DISCLOSURE STATEMENT

U.S. Pat. No. 4,983,481 to Yu, issued Jan. 8, 1991—An imaging member without an anti-curl layer is disclosed having improved resistance to curling. The imaging member comprises a flexible supporting substrate layer, an electrically conductive layer, an optional adhesive layer, a charge generator layer and a charge transport layer, the supporting layer having a thermal contraction coefficient substantially identical to the thermal contraction coefficient of the charge transport layer. See, for example, column 17, line 22–column 20, line 14. The substrate may be biaxially oriented, e.g. see column 6, lines 28–42.

U.S. Pat. No. 4,621,009 to Lad, issued Nov. 4, 1986—A coating composition is disclosed for application onto a plastic film to form a coating capable of bonding with xerographic toner. The coating composition consists of a resin binder, preferably a polyester resin, a solvent for the resin binder, filler particles, and at least one crosslinking and antistatic agent. The coating compostion is applied to a polyester film, preferably a film of polyethylene terephthalate, under conditions sufficient to fix toner onto the coating without wrinkling. See, for example, column 1, line 63–column 2, line 2.

U.S. Pat. No. 4,675,233 to Nakahara et al, issued Jun. 23, 1987—An ink transfer material is disclosed for printers which addresses the problems of longitudinal tear, plastic deformation and thermal shrinkage. The ink transfer material comprises a biaxially oriented polyester film, such as polyethylene terephthalate and a transfer ink layer deposited on one side of the polyester film.

U.S. Pat. No. 4,942,105 to Yu, issued Jul. 17, 1990—A flexible electrophotograhic imaging member resistant to delamination is disclosed having an anti-curl layer with improved adhesion to a supporting substrate. The imaging member comprises at least one electrophotographic layer, a supporting substrate layer having an electrically conductive surface and an anti-curl layer. The anti-curl layer comprises a film forming binder and a copolyester resin reaction product of terephthalic acid, isophthalic acid, ethylene glycol and 2,2-dimethyl-1-propane diol.

Thus, the characteristics of electrostatographic imaging members comprising a supporting substrate coated on one side with at least one photoconductive layer and coated or uncoated on the other side with an anti-curl layer exhibit deficiencies which are undesirable in automatic, cyclic electrostatographic copiers, duplicators, and printers.

SUMMARY OF THE INVENTION

It is an object of the invention to provide an electrostatographic imaging member fabrication process which overcomes the above-noted disadvantages.

It is an another object of this invention to provide an electrostatographic imaging member fabrication process with improved resistance to curling.

It is another object of this invention to provide an electrostatographic imaging member fabrication process having greater yields.

It is another object of this invention to provide an electrostatographic imaging member fabrication process capable of higher throughput.

It is another object of this invention to provide an electrostatographic imaging member fabrication process which need not apply an anti-curl layer.

It is still another object of this invention to provide an electrostatographic imaging member fabrication process which produces an imaging member having improved resistance to dynamic fatigue cracking of a charge transport layer flexing over machine belt module rollers.

It is another object of this invention to provide an electrostatographic imaging member fabrication process which produces an imaging member having an increased life.

It is another object of this invention to provide an electrostatographic imaging member fabrication process which eliminates anti-curl layer coating, drying and solvent recovery steps.

It is still another object of this invention to provide an electrostatographic imaging member fabrication process which improves adhesion between a supporting substrate and the layers which it supports.

The foregoing objects and others are accomplished in accordance with this invention by providing a process for fabricating an electrostatographic imaging member comprising providing a flexible substrate comprising a solid thermoplastic polymer, forming an imaging layer coating comprising a film forming polymer on the substrate, heating the coating, cooling the coating, and applying sufficient predetermined biaxial tensions to the substrate while the imaging layer coating is at a temperature greater than the glass transition temperature of the imaging layer coating to substantially compensate for all dimensional thermal contraction mismatches between the substrate and the imaging layer coating during cooling of the imaging layer coating and the substrate, removing application of the biaxial tension to the substrate, and cooling the substrate whereby the final hardened and cooled imaging layer coating and substrate are substantially free of stress and strain.

The expression "imaging layer" as employed herein is defined as any thick film forming layer of an electrostatographic imaging member that is applied to a substrate or coated substrate. Typical imaging layers include charge transport layers, thick single photoconductive layers (differentiated from multiple active layers systems), electrographic dielectric layers and the like. A "thick" imaging layer is defined herein as one having a dry thickness between about 10 micrometers and about 75 micrometers. The term "substrate" is defined herein as a flexible member comprising a solid thermoplastic polymer that may be coated or uncoated.

Generally, the imaging member comprises a flexible supporting substrate having an electrically conductive surface and at least one imaging layer. The flexible supporting substrate layer having an electrically conductive surface may comprise any suitable flexible web or sheet comprising a solid thermoplastic polymer. The flexible supporting substrate layer having an electrically conductive surface may be opaque or substantially transparent and may comprise numerous suitable materials having the required mechanical properties. For example, it may comprise an underlying flexible insulating support layer coated with a flexible electrically conductive layer, or merely a flexible conductive layer having sufficient mechanical strength to support the electrophotoconductive layer or layers and the anti-curl layer. The flexible electrically conductive layer, which may comprise the entire supporting substrate or merely be present as a coating on an underlying flexible web member, may comprise any suitable electrically conductive material including, for example, aluminum, titanium, nickel, chromium, brass, gold, stainless steel, copper iodide, carbon black, graphite and the like dispersed in the solid thermoplastic polymer. The flexible conductive layer may vary in thickness over substantially wide ranges depending on the desired use of the electrophotoconductive member. Accordingly, the conductive layer can generally range in thicknesses of from about 50 Angstrom units to about 150 micrometers. When a highly flexible photoresponsive imaging device is desired, the thickness of the conductive layer may be between about 100 Angstrom units to about 750 Angstrom units. Any suitable underlying flexible support layer of any suitable material having a linear thermal contraction coefficient substantially different from the thermal contraction coefficient of the charge transport layer, thick single photoconductive layer (differentiated from multiple active layers systems) or electrographic dielectric layer containing a thermoplastic film forming polymer alone or a thermoplastic film forming polymer in combination with other materials may be used. Typical underlying flexible support layers comprising film forming polymers having linear thermal contraction coefficients substantially different from the linear thermal contraction coefficient of the typically thick electrically active layer or layers include biaxially oriented polyethylene terepthalate, polyimide, polysulfone, polyethylene naphthalate, polypropylene, nylon, and the like. The thermal contraction mismatch between these support layers and typical electrically active layers, when combined, will result in the curling of imaging members.

Other typical underlying flexible support layers comprising film forming polymers having a linear thermal contraction coefficient substantially the same as the linear thermal contraction coefficient of the typically thick electrically active layer or layers include insulating non-conducting materials comprising various resins such as polyethersulfone resins, polycarbonate resins, polyvinyl fluoride resins, polystyrene resins and the like. Specific examples of supporting substrates are polyethersulfone (Stabar S-100, available from from ICI), polyvinyl fluoride (Tedlar, available from E. I. DuPont de Nemours & Company), polybisphenol-A polycarbonate (Makrofol, available from Mobay Chemical Company) and amorphous polyethylene terephthalate (Melinar, available from from ICI Americas, Inc.). When these supporting substrates and certain electrically active layers having substantially the same linear thermal contraction coefficients are combined, as described in U.S. Pat. No. 4,983,481 issued Jan. 8, 1991, they will produce curl-free imaging members. The entire disclosure of U.S. Pat. No. 4,983,481 is incorporated herein by reference. Unlike the untreated materials combinations disclosed in U.S. Pat. No. 4,983,481, the materials used in the imaging members of this invention have substantially different linear thermal contraction coefficients such that they required the biaxial tension/-heat treatment process of this invention to achieve the desired flat imaging member.

The coated or uncoated flexible supporting substrate layer is highly flexible and may have any number of different configurations such as, for example, a sheet, a scroll, an endless flexible belt, and the like. Preferably, the insulating web is in the form of an endless flexible belt and comprises a commercially available biaxially oriented polyethylene terephthalate substrate known as Melinex 442, available from ICI. This substrate material has a thermal contraction (or expansion) coefficient that is substantially different from that of the preferred charge transport materials, thick single photoconductive layer or electrographic dielectric layer.

Although the following discussion is directed to charge transport layers, it is also applicable to thick single photoconductive layers and electrographic dielectric layers. Preferred charge transport layer polymers include, for example, polycarbonate, polystyrene, polyarylate, polyethercarbonate and the like.

The linear thermal contraction coefficient is defined as the fractional dimensional shrinking upon cooling per °C. The thermal contraction coefficient characteristics are determined for the substrate and charge transport layers by measurements taken in two directions along the plane of the layers, the two directions being about 90° apart. The thermal contraction coefficient (or expansion) may be determined by well known ASTM techniques, including those described, for example, in "Standard Test Method for Coefficient of Cubicle Thermal Expansion of Plastics, ASTM Designation: D 864-52" (Reapproved 1978); "Standard Test Method for Linear Thermal Exapansion of Solid Materials with a Vitreous Silica Dilatometer", ASTM Designation: E 228-85; and "Standard Test of Coefficient of Linear Thermal Expansion of Plastics", ASTM Designation: D 696-79. The thermal contraction coefficient for plastics involves a reversible thermal change in length per unit length resulting from a temperature change. The measurements are taken at temperatures below the glass transition temperatures of the film forming polymers in the layers and may be made with any suitable device such as a conventional dilatometer. The thermal contraction coefficient varies significantly when the glass transition temperature is exceeded. Therefore, the thermal contraction coefficient value for purposes of this invention is measured at a temperature below the glass transition temperature. A typical procedure for measuring the thermal contraction coefficient is ASTM D696-79 Standard Test Method for Coefficient of Linear Thermal Expansion of Plastics. As is well known in the art, the thermal contraction coefficient of a material is the same as the thermal expansion coefficient of that material. For purposes of testing to determine the thermal contraction coefficient of a given type of material, each layer is formed and tested as an independent layer.

The film forming polymers employed in the substrate layer and in the charge transport layer should preferrably be isotropic and not anisotropic. An isotropic material is defined as a material having physical and mechanical properties that are identical in all directions. Isotropic materials expand or contract in the same proportion in all directions and retain their original shape when heated or cooled, whereas anisotropic materials have different degrees of directional expansion or contraction such that their original shapes are distorted when heated or cooled. Isotropic materials may be tested by either cubical or linear thermal expansion coefficient tests. An anisotropic material is defined as a material having physical and mechanical properties that are not identical in all directions. An example of an anisotropic material is biaxially oriented polyethylene terephthalate (PET), e.g. Melinex, available from ICI Americas, Inc.

Properties of two specific substrate materials are set forth in the following Table:

TABLE I

Physical/Mechanical Properties of Various Typical Substrates

| Property | Polyethersulfone (Stabar S-100) | Biaxially Oriented PET (Melinex 442) |
|---|---|---|
| Thermal Expansion Coeff. (in/in-°C.) | $6.0 \times 10^{-5}$ (WD)<br>$6.0 \times 10^{-5}$ (TD) | $2.2 \times 10^{-5}$ (WD)<br>$1.8 \times 10^{-5}$ (TD) |
| Modulus (lb/in$^2$) | $3.5 \times 10^5$ (WD)<br>$3.5 \times 10^5$ (TD) | $5.9 \times 10^{-5}$ (WD)<br>$6.5 \times 10^{-5}$ (TD) |
| Service Temp. (°C.) | <225 | <150 |
| Creep at 1 lb/in Tension (105° C./85% RH) | Negligible | Slight |
| Optical Clarity | Clear | Clear |
| Characteristic | Isotropic | Anisotropic |

where:
WD is in the web direction (i.e. longitudinal)
TD is in the transverse direction (i.e. across the width)

If desired, any suitable charge blocking layer may be interposed between the conductive layer and the photogenerating layer. Some materials can form a layer which functions as both an adhesive layer and charge blocking layer. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because its cyclic stability is extended. The entire disclosure of U.S. Pat. No. 4,464,450 is incorporated herein by reference. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof.

Generally, satisfactory results may be achieved when the reaction product of a hydrolyzed silane and metal oxide layer forms a blocking layer having a thickness between about 20 Angstroms and about 2,000 Angstroms.

In some cases, intermediate layers between the blocking layer and the adjacent charge generating or photogenerating layer may be desired to improve adhesion or to act as an electrical barrier layer. If such layers are utilized, they preferably have a dry thickness between abut 0.01 micrometer to about 5 micrometers. Typical adhesive layers include filmforming polymers such as polyester, polyvinylbutyral, polyvinylpyrolidone, polyurethane, polymethyl methacrylate and the like.

Generally, the electrophotoconductive imaging member of this invention comprises a supporting substrate layer, a metallic conductive layer, a charge blocking layer, an optional adhesive layer, a charge generator layer, a charge transport layer, and an optional anti-curl layer on the side of the substrate layer opposite the electrically active charge generator and charge transport layers. Any suitable charge generating or photogenerating material may be employed as one of the two electrically operative layers in the multilayer photoconductor of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. Nos. 4,265,990, 4,233,384, 4,471,041, 4,489,143, 4,507,480, 4,306,008, 4,299,897, 4,232,102, 4,233,383, 4,415,639 and 4,439,507. The disclosures of these patents are incorporated herein by reference in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. Nos. 3,121,006 and 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, a photoconductive material need only to comprise about 1 percent or less by volume of the binder layer with no limitation on the maximum amount of photoconductor in the binder layer. Generally for generator layers containing an electrically active matrix or binder such as polyvinyl carbazole or poly(hydroxyether), from about 5 percent by volume to about 60 percent by volume of the photogenerating pigment is dispersed in about 95 percent by volume to about 40 percent by volume of binder, and preferably from about 7 percent to about 30 percent by volume of the photogenerating pigment is dispersed in from about 93 percent by volume to about 70 percent by volume of the binder. The specific proportions selected also depends to some extent on the thickness of the generator layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The relatively thick active charge transport layer, in general, has a thermal contraction coefficient substantially different from the thermal contraction coefficient of the typical biaxially oriented polyethylene terephthalate supporting layer. The charge transport layer should also be capable of supporting the injection of photo-generated holes and electrons from the charge transport layer and allowing the transport of these holes or electrons through the charge transport layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conductive in the absence of illumination, i.e. a rate sufficient to prevent the formation and retention of an electrostatic latent image thereon.

Polymers having the capability of transporting holes contain repeating units of a polynuclear aromatic hydrocarbon which may also contain heteroatoms such as for example, nitrogen, oxygen or sulfur. Typical polymers include poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; the polymeric reaction product of N,N'-diphenyl N,N' bis (3-hydroxy phenyl)-[1,1' biphenyl]-4,4'diamine and diethylene glycol bischloroformate, and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

Preferred electrically active layers comprise an electrically inactive resin material, e.g. a polycarbonate, polystyrene or polyether carbonate made electrically active by the addition of one or more of the following compounds poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble.

The charge transport layer forming mixture preferably comprises an aromatic amine compound of one or more compounds having the general formula:

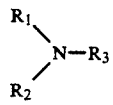

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like.

Excellent results in controlling dark decay and background voltage effects have been achieved when the imaging members comprising a charge generation layer comprise a layer of photoconductive material and a contiguous charge transport layer of a polycarbonate resin material having a molecular weight of from about 20,000 to about 120,000 having dispersed therein from about 25 to about 75 percent by weight of one or more diamine compounds having the general formula:

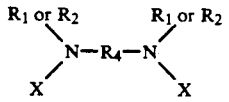

wherein $R_1$, $R_2$, and $R_4$ are defined above and X is selected from the group consisting of an alkyl group having from 1 to about 4 carbon atoms and chlorine, the photoconductive layer exhibiting the capability of photogeneration of holes and injection of the holes and the charge transport layer being substantially non-absorbing in the spectral region at which the photoconductive layer generates and injects photogenerated holes but being capable of supporting the injection of photogenerated holes from the photoconductive layer and transporting the holes through the charge transport layer.

Examples of charge transporting aromatic amines for charge transport layers capable of supporting the injection of photogenerated holes of a charge generating layer and transporting the holes through the charge transport layer include triphenylmethane, bis(4-diethylamine-2-methylphenyl) phenylmethane; 4'-4''-bis(-diethylamino)-2',2''-dimethyltriphenyl-methane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in a suitable solvent may be employed in the process of this invention. Typical inactive resin binders soluble in solvents include polycarbonate resins such as poly(4,4'-isopropylidenediphenyl carbonate) and poly[1,1-cyclohexanebis(4-phenyl)carbonate], polystyrene resins, polyether carbonate resins, 4,4'-cyclohexilidene diphenyl polycarbonate, polyarylate, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000 (available as Lexan 145 from General Electric Company); poly(4,4'-isopropylidene-diphenylene carbonate) with a molecular weight of from about 40,000 to about 45,000 (available as Lexan 141 from the General Electric Company); a polycarbonate resin having a molecular weight of from about 50,000 to about 100,000, (available as Makrolon from Farbenfabricken Bayer A.G.) and a polycarbonate resin having a molecular weight of from about 20,000 to about 50,000 (available as Merlon from Mobay Chemical Company). Methylene chloride solvent is a desirable component of the charge transport layer coating mixture for adequate dissolving of all the components and for its low boiling point. Layers comprising such polycarbonate resins loaded with about 50 percent by weight of an electrically active diamine compound, based on the total weight of the layer, have a thermal contraction coefficient between about $5.6\times10^{-5}$/°C. and about $7.5\times10^{-5}$/°C., and a Tg of about 81° C.

In all of the above charge transport layers, the activating compound which renders the electrically inactive polymeric material electrically active is preferably present in amounts of from about 15 to about 75 percent by weight.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

Optionally, a thin overcoat layer may also be utilized to improve resistance to abrasion. These overcoating layers may comprise organic polymers or inorganic polymers that are electrically insulating or slightly semi-conductive.

For electrographic imaging members having a single electrically active layer, a charge transport layer is not utilized. These single electrically active layers are well known in the art and described, for example in U.S. Pat. No. 3,121,006, the entire disclosure thereof being incorporated herein by reference. A typical single electrically active layer comprises photoconductive particles dispersed in a polymeric film forming binder. Generally, these single electrically active layer have a thickness between about 10 micrometers and about 50 micrometers. However, thicknesses outside this range may be used depending on the specific materials selected.

For electrographic imaging members, a flexible dielectric layer overlying the conductive layer may be substituted for the photoconductive layers. Any suitable, conventional, flexible, electrically insulating dielectric film forming polymer may be used in the dielectric layer of the electrographic imaging member. These dielectric layers generally have a thickness between about 10 micrometers and about 400 micrometers.

Film forming polymers employed in charge transport layers or dielectric imaging layers will always exhibit isotropic characteristics when applied by solution coating techniques. Polycarbonate (e.g. Makrolon available from Farbenfabricken Bayer A.G.), that is substantially free of solvent has a glass transition temperature $T_g$ of about 158° C. whereas polycarbonate that contains residual solvent can, for example, have a Tg of less than about 135° C. The coating and drying of a thick layer of this material can be effected at a temperature below the glass transition temperature of the final, dried polycarbonate layer formed on the flexible substrate, i.e. below about 158° C. However, a flexible substrate coated with a material which is dried at room temperature can curl to a greater degree than if drying is conducted at an elevated temperature because extensive shrinking of the applied coating can occur during room temperature drying after the solidification and adhesion point is reached due to the extent of volume contraction induced by removal of large amounts of remaining solvent and with no dimensional contraction in the substrate. While at an elevated drying temperature, most of the solvent is removed while the coating material is maintained at a temperature above its $T_g$ which keeps the coating material in a flowable state and the residual solvent present in the coating functions as a plasticizer to lower the $T_g$ of the polycarbonate coating.

If an imaging member comprising an anisotropic web substrate of biaxially oriented polyethylene terephthalate (PET) having a coefficient of thermal contraction of $2.2\times10^{-5}$/°C. in the web direction (WD) and $1.8\times10^{-5}$° C. in the transverse direction (TD), and a coating layer of polycarbonate (Makrolon), having a thickness of about 24 micrometers and a coefficient of thermal contraction of $6.5\times10^{-5}$/°C. applied by solution coating, is normally flat at elevated temperatures during drying, the coated web will tend to curl toward the dielectric imaging layer upon cooling to ambient room temperature because the polycarbonate layer will contract to a greater extent than the biaxially oriented PET layer. Thus, if this curled coated web is solution coated with another polycarbonate coating on the back side of the PET substrate and opposite to the polycarbonate imaging layer as the outer substrate layer, the requirement of heating to drive off the coating solvent at an elevated temperature will produce a counteracting contraction force after cooling to room temperature to balance the curling effect. If the applied anti-curl polycarbonate outer substrate layer is of the same thickness as the polycarbonate imaging layer, the resulting flexible imaging member will lie flat on a flat surface.

If, instead of being subjected to the above described elevated temperature process, the flat biaxially oriented the PET web is coated with thick imaging layer such as a 50 percent by weight Makrolon and 50 percent by weight aromatic diamine solution of charge transport layer (CTL) at room temperature without the application of heat, the web tends to curl when the coating solvent evaporates due to the dimensional contraction of the applied coating from the point in time when the applied CTL coating solidifies and adheres to the underlying surface. Once this solidification and adhesion point is reached, further evaporation of coating solvent causes continued shrinking of the applied coating layer due to volume contraction resulting from removal of additional solvent will cause the coated web to curl toward the applied layer because the PET substrate does not undergo any dimensional changes. This shrinking occurs isotropically, i.e., three-dimensionally. In other words, from the point in time when the applied coating has reached a solid state and is anchored at the interface with the underlying support layer, continued shrinking of the applied coating causes dimensional decreases in the applied coating which in turn builds up internal tension stress and, therefore, forces the entire coated structure to curl toward the dry CTL applied coating. If the coated article has a circular shape, the curled structure will resemble that of a bowl. If placed in an oven and heated to about 90° C., this curled article will flatten because the Tg of the applied dry CTL coating is about 81° C. and the applied CTL coating will liquefy and no longer exert any stress on the coated web. At this instance, if this liquefied CTL coating is allowed to cool to just above 81° C., the CTL coating remains in a highly viscous liquid state and flowable and still does not exert any stress on the underlying substrate layer. However, this liquefied CTL coating will transform rapidly into a solid coating at 81° C. and anchors itself to the underlying layer. Further, cooling of this solid CTL coating from 81° C. down to room temperature causes the CTL coating to contract at about 3.5 to 4 times greater than that of the underlying biaxially PET substrate layer so that the coated article will curl up toward the CTL coating.

To prevent photoreceptor web curling after CTL coating and drying, various alternative processes of the present invention can be employed to render the photoreceptor web free of curling without the application of an anti-curl layer such as the following:

(I) Biaxial stretching of the web to the precisely predetermined strains during the application and heating/drying of all of the applied coatings.

(II) Biaxial stretching of the web to the precisely predetermined strains including previously applied thin coatings (e.g. conductive, blocking, adhesive, generating) only during the CTL solution coating and heating/drying processes.

(III) Biaxial stretching to the precisely predetermined strains and heat treatment of a web bearing previously applied and dried coatings (e.g. conductive, blocking, adhesive, generating, and CTL) photoreceptor web to a temperature of exceeding the $T_g$ of the CTL.

To achieve the results of the present invention, the biaxial stretching described in all of these three processes should be released only after the web is cooled down to a temperature of at least about 5° C. below the $T_g$ of the CTL or to room ambient temperature to ensure that the resulting photoreceptor web will be curl-free. Since the thermal contraction of the CTL is approximately 3.5 times greater than the thermal contraction of the PET supporting substrate and since the substrate is biaxially stretched to the strains equivalent to the 2-dimensional thermal contraction mismatches, the elastic retractions of the substrate upon release of the imposed strains will spontaneously compensate the mismatches as well as eliminate curling of the photoreceptor. To yield the required strains in both directions to compensate the thermal contraction mismatches with an isotropic thick imaging layer by biaxial stretching of the web, the force applied to the web direction (WD) is essentially different from the force applied to the transverse direction (TD) if an anisotropic web, such as biaxially oriented PET, is used as the supporting substrate.

Any suitable technique may be utilized to apply the stress to the substrate. For example, where a square sheet is utilized as a substrate, clamps may be applied to each side of the sheet and transverse stress applied to each of the clamps in a direction away from the center of the square sheet. Where a long moving web is utilized as a substrate, clamps may be applied to each side of the edges of the web while the web is being pulled longitudinally, the clamps move with the web on any suitable support such as wheeled carriages on rails or slides in channels movable parallel to the direction that the web is being pulled. The clamps may be biased away from the centerline of the web by any suitable means such as adjustable springs, air cylinders, weighted cables, and the like mounted on the movable supports. The stress applied to the web in a longitudinal direction may be supplied by any suitable means. For example, the web supply roll for the web may be fitted with an adjustable disk brake that resists unwinding of the supply roll and the web take up roll may be driven by a variable speed electric motor.

The amount of tension force F per inch substrate width to be applied in each direction in order to precisely compensate for the thermal conatraction mismatch is represented by the following equations:

In the web direction (WD), $$F_{WD}=\{M_{WD}[\alpha_{CTL}-\alpha_{WD})\,(T_g-T_{rm}]\}(I)$$

In the transverse direction (TD), $$F_{TD}=\{M_{TD}[\alpha_{CTL}-\alpha_{TD})\,(T_g-T_{rm}]\}(I)$$

where:

WD and TD are the web direction and transverse direction, respectively, in the substrate M is Young's modulus, $\alpha$ is the thermal contraction coefficient, $T_g$ is the glass transition temperature of the CTL, $T_{rm}$ is the ambient room temperature, and I is the substrate thickness.

When the applied tension forces are less than about 20 percent of the forces $F_{WD}$ and $F_{TD}$ (calculated using the above equations), the dry coated web will curl upwardly toward the CTL after the biaxially applied tension forces are removed. However, when the applied tension forces are greater than about 20 percent of the forces $F_{WD}$ and $F_{TD}$ calculated using the above equations), the dry coated web will curl downwardly away from the CTL after the biaxially applied tension forces are removed. The amount of stress applied in the different direction depends on the properties of the substrate. For example, depending on the techniques for fabricating the web, more tension may be required in one direction compared to the other if the substrate is anisotropic. It is preferred that the biaxial tension forces applied should neither be less nor more than about 10 percent of the compensation forces $F_{WD}$ and $F_{TD}$. Optimum results are achieved when the applied biaxial tension forces are not less or more than about 5 percent of the compenstional forces $F_{WD}$ and $F_{TD}$ calculated with the above equations. The biaxial tension forces applied to the substrate should be at a tension below the elastic limit of the substrate to avoid permanent deformation. Generally, the strain resulting from the applied tension force is less than about 0.26 percent, a relatively small elongation for polymeric materials.

In one embodiment, the biaxial tension forces applied to the substrate slightly exceed the calculated compensational forces to place the CTL under compression after the applied tension forces are removed from the substrate subsequent to cooling of the imaging member below the $T_g$ of the CTL. Preferably, the amount of excess tension force applied is up to about +5 percent of the predetermined compensational forces. This will reduce the amount of tensile bending stress which is induced when the photoconductive imaging member belt flexes over a small diameter (e.g. 10 mm) roll. This extends the dynamic fatigue CTL cracking life of the photoconductive imaging member belt.

Preferably, the biaxial stress or tension force applied to the substrate is applied prior to or during application of any coating solutions. Satisfactory results may be achieved if the biaxial stress is applied to a substrate after it has been coated with various thin layers such as a conductive coating, blocking layer, adhesive layer, charge generating layer and the like. When substrates coated with a charge generating layer prior to application of biaxial stress, no cracks developed in the final coated member as confirmed by print testing. This is achieved because the strains caused by the biaxial tension force is much less than the cracking strains of the generating layer, the adhesive layer, the blocking layer and the conductive layer.

The biaxial stress may be applied to the substrate prior to or during the application of a thick imaging layer such as a charge transport layer. It is important that biaxial tension force be applied to the substrate at least during the period when the temperature of the imaging layer is reduced from a point about the $T_g$ of the imaging layer to a point below the $T_g$ of the imaging layer. Preferrably, the temperature of the imaging layer is reduced to a point at least about 5° C. below the $T_g$ of the imaging layer before the biaxial tension force applied to the substrate is released. Usually the biaxial tension force is released when ambient room temperature is attained. This, of course, is well below the $T_g$ of the imaging layer. Thus, the application of heat to the imaging layer to raise the temperature to a point above $T_g$ of the imaging layer can take place during the coating and drying operation or long after the imaging layer has been applied and hardened.

The applied imaging layer should be in a solid state before reducing or removing the tension being applied biaxially to the substrate. More specifically, the solid imaging layer should be substantially free of solvents and be cooled to a temperature below the glass transition temperature ($T_g$) of the imaging layer before the tension applied to the substrate is removed. It is important to reiterate that the applied biaxial tension forces should be released only when the imaging layer has been cooled to a temperature below its $T_g$ and has transformed itself from a viscous liquid to a solid state in order to achieve the objectives of this invention. The expression "solid" is defined as a material in a state which does not flow at a temperature less than the glass transition temperature (Tg) of the imaging layer material. The expression "flow" as employed herein is defined as changing shape at less than about one month in the absence of any externally applied stress other than gravity.

For embodiments where the thick imaging layer is freshly formed, satisfactory results are achieved when the tension force is removed from the substrate after the imaging layer is applied, dried and cooled to a temperature below the $T_g$ of the imaging layer. Preferably, the dried imaging layer contains less than about 0.1 percent by weight solvent based on the total weight of the imaging layer. Optimum results are achieved when the dried imaging layer comprises less than about 0.05 percent by weight solvent based on the total weight of the layer.

Generally, when tension force is removed from the substrate, the rate of removal is preferably substantially the same in both directions. Preferably, such tension force is reduced gradually during cooling of the coated substrate after drying or after heating a precoated substrate below the $T_g$ of the imaging layer. For freshly coated imaging members, optimum results are achieved when tension force is removed from the substrate upon completion or substantial completion of both the drying and cooling steps. If the tension force is removed after drying and cooling are completed, removal of tension force in one direction prior to the removal of tension force in the other direction is not critical. For example, for long web shaped substrates, the transversely applied tension force (across the width of the web) may be removed after drying and cooling while maintaining the tension longitudinally along the web. Generally, the tension applied to the web during winding is significantly less than the tension applied during biaxial stretching.

Typical thickness of the dried thick imaging layer is between about 10 micrometers and about 50 micrometers. These imaging layers are relatively thick and may be a charge transport layer, a single electrophotographic layer comprising a binder and photosensitive pigment particles, or a dielectric imaging layer for electrophotographic imaging members. Generally, these imaging layers having an outer surface which is utilized as an imaging surface.

BRIEF DESCRIPTION OF THE DRAWING

A more complete understanding of the process of the present invention can be obtained by reference to the accompanying drawing wherein the FIGURE is a schematic illustration in of a sample of an electrophotographic imaging member is subjected to biaxial stretching.

This FIGURE merely schematically illustrates the invention and is not intended to indicate relative size and dimensions of the biaxial stretching system or components thereof.

DETAILED DESCRIPTION OF THE DRAWING

Referring to the FIGURE, a sample of a photoreceptor 10 comprising a substrate, a thin metallic conductive layer, a thin blocking layer, a thin adhesive layer, a thin charge gnerating layer, and a thick imaging layer cut into a cross-like shape is shown mounted in a fixture for applying biaxial tension. This photoreceptor 10 spontaneously curls when no tension is applied. The cross-like sample has curved intersections 12 adjacent sides of adjacent legs 14. Each leg 14 is bent around and supported by idler rolls 16. The ends of legs 14 are secured to clamps 18 to which are attached cables 20. A weight (not shown) or other suitable means is hung on the ends of the cables 20 to apply tension to each leg 14 of photoreceptor 10 thereby applying biaxial tension to photoreceptor 10. The entire set up is then heated in a conventional oven (not shown) to a temperature exceeding the $T_g$ of the thick imaging layer while the the biaxial tension is applied and thereafter allowed to cool down to ambient room temperature. After the photoreceptor 10 is cooled to ambient room temperature, the weights are removed and the photoreceptor 10 is unclamped and examined for the presence or absence of curls.

By biaxial stretching the substrate of the photoreceptor to produce a predetermined strain as well as elevating the photoreceptor temperature to a temperature exceeding the $T_g$ of the imaging layer, photoreceptor curling can be eliminated when the photoreceptor is cooled to ambient room temperature as the applied tension force is removed. Stretching of the substrate is accomplished at a tension force below the elastic limit of the photoreceptor substrate with the substrate retracting to its original dimensions upon cooling to a temperature below the $T_g$ of the imaging layer and removal of the applied strain. Since this retraction precisely compensates for the thermal dimensional contraction mismatch between the thick imaging layer and the substrate in the photoreceptor, a curl-free photoreceptor can be obtained. In essence, this invention utilizes the precise elastic dimensional recovery of the substrate upon release of the applied mechanical stress to correct the dimensional mismatch which occurs due to the different thermal characteristics of the thick imaging layer and the supporting substrate.

The photoreceptor of this invention reduces the number of coating layers required in the final photoreceptor product. The number of steps and costs for fabricating the photoreceptor of this invention is also reduced. Moreover, the rate of fabrication and product yield are increased. Also, the common phenomenon of charge transport layer internal stress build-up is removed, thereby prolonging its dynamic fatigue mechanical service life. In addition, photoreceptor deformation is eliminated. Further, adhesion between the substrate and overlying layers is improved. In addition, this invention reduces print defects by markedly extending the cycling resistance to curling of the photoreceptor.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A control photoconductive imaging member was prepared by providing a titanium coated biaxially oriented polyethylene terephthalate (Melinex 442, available from ICI Americas, Inc.) substrate having a thickness of 3 mil (76.2 micrometers), a width of 21 cm and a length of 28 cm, and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 5 minutes at 135° C. in a forced air oven. The resulting blocking layer had a dry thickness of 0.04 micrometer.

An adhesive interface layer was then prepared by the applying to the blocking layer a coating having a wet thickness of 0.5 mil and containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a Bird applicator. The adhesive interface layer was allowed to dry for 1 minute at room temperature and 5 minutes at 135° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 2.0 micrometers. Notwithstanding the fact that a thermal contraction mismatch between the PET substrate and the coating layers of the photogenerating layer, adhesive layer, and blocking layer existed, the imaging member at this state of fabrication did not curl because these coating layers were so thin that the total contraction force generated by their internal stresses was too small to cause curling.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'diamine and Makrolon R, a polycarbonate resin having a molecular weight of from about 50,000 to 100,000 commercially available from Farbensabricken Bayer A.G. The resulting mixture was dissolved in by weight methylene chloride to form a solution containing 15 percent by weight solids. This solution was applied on the photogenerator layer using a Bird applicator to form a coating which upon drying had a thickness of 24 microns. During this coating process the humidity was equal to or less than 15 percent. The resulting photoreceptor device containing all of the above layers was annealed at 135° C. in a forced air oven for 5 minutes and thereafter cooled to ambient room temperature.

No anti-curl coating was applied to the substrate. The anisotropic substrate had a transverse (TD) linear thermal contraction coefficient of $1.8\times10^{-5}$/°C. and a web direction (WD) linear thermal coefficent of $2.2\times10^{-5}$/°C. compared to the charge transport layer which had a greater linear thermal contraction coefficient of $6.5\times10^{-5}$/°C. While unrestrained, the opposite edges of the resulting photoreceptor curled upwardly toward the coated side to form a 1.5 inch (3.8 cm) diameter roll.

EXAMPLE II

A standard control photoconductive imaging member was prepared in exactly the same manner and using the same materials as described in Example I, except that a dry 14 micrometers thick anti-curl layer was applied to the back side of the substrate, opposite to the side bearing the charge transport layer to counteract curl and to render the resulting photoconductive imaging member flat.

The anti-curl coating was prepared by combining 8.82 grams of polycarbonate resin (Makrolon 5705, 8.18 percent by weight solids, available from Bayer AG), 0.9 gram of polyester resin (Vitel PE 100, available from Goodyear Tire and Rubber Co.), and 90.07 grams of methylene chloride in a glass container to form a coating solution containing 8.9 percent solids. The container was covered tightly and placed on a roll mill for about 24 hours until the polycarbonate and polyester were dissolved in the methylene chloride. The anti-curl coating solution was applied to the rear surface (side opposite the photoconductive imaging layer) and dried at 135° C. for about 5 minutes to yield the desired anti-curl layer thickness.

EXAMPLE III

A photoconductive imaging member was prepared according to the same procesures and same materials described in Example I, except that the biaxially oriented (anisotropic) polyethylene terephthalate substrate was replaced by a 4 mil thick isotropic polyether sulfone substrate (Stabar S-100, available from ICI Americas, Inc.). Since the linear thermal contraction coefficient of the polyether sulfone, at $6.0\times10^{-5}$/°C. is about equivalent to that ot the coated charge transport layer, the resulting photoconductive member was curl free. Thus, as pointed out in U.S. Pat. No. 4,983,481, photoconductive member are substantially curl free when the difference in linear thermal contraction coeficient of a charge transport layer and substrate layer are very small, e.g. between about $-2\times10^{-5}$/°C. and about $+2\times10^{-5}$/°C. Thus, without employing the treatment of the present invention, undesirable curl can occur when the difference in linear thermal contraction coefficient of a charge transport layer and substrate layer is outside of these limits.

EXAMPLE IV

A sample of the photoreceptor described in Example I was cut into a cross-like shape similar to that shown in the FIGURE. The curved intersection of each side of the adjacent legs of the cross had a radius of curvature of 4.45 cm (1.75 inches). The distance from the end of each leg to the beginning of each curved intersection was 7.6 cm (3 inches). The distance from the center of each curved intersection was 5.1 cm (2 inches) from the center of each adjacent curved intersection. Imaginary lines connecting the centers of each adjacent curved intersection formed a square having sides 5.1 cm (2 inches long). The sample was then tension stretched as shown in the FIGURE. Based on the 5.1 cm (2 inches)×5.1 cm (2 inches) dimensions at the center of the test sample, biaxial sample stretching was achieved by hanging 3,904 grams (8.6 lb) weights on cables attached to clamps secured to the two legs in the longitudinal direction of the original web and 4,631 grams (10.2 lb) weights on cables attached to clamps secured to the two legs in the transverse direction of the original web to produce a 1,537 grams/cm (4.3 lb./in) longitudinal direction tension and 1,823 grams/cm (5.1 lb/in) transverse direction tension, respectively. Since the thickness of conductive, blocking, adhesive and generating layers are very thin and can be considered negligible when compared to the thickness of the flexible polyethylene terephthalate (PET) substrate, the internal strain build-up in the charge transport layer (CTL) was calculated by means of the equation below:

The following factors were known:

Anisotropic $\alpha_{WD}$ for PET $=2.2\times10^{-5}$/°C.

$\alpha_{TD}$ for PET $=1.8\times10^{-5}$/°C. (where WD is Web Direction, TD is Transverse Direction and $\alpha$ is the coefficient of thermal contraction)

Isotropic $\alpha_{CTL}=6.5\times10^{-5}$/°C.

CTL strain due to contraction mismatch between 81° C. and 25° C. =(Total contraction of CTL − Total contraction of PET)=$[\alpha_{CTL}-\alpha_{PET}](81° C.-25° C.)$ (1)

Therefore, using equation (1)

$$CTL \text{ strain in the } WD = [\alpha_{CTL} - \alpha_{WD} \text{ of } PET](81° C. - 25° C.) = [(6.5 \times 10^{-5} - 2.2 \times 10^{-5})/°C.](81° C. - 25° C.) = 0.24\%$$

$$CTL \text{ strain in the } TD = [\alpha_{CTL} - \alpha_{TD} \text{ of } PET](81° C. - 25° C.) = [(6.5 \times 10^{-5} - 1.8 \times 10^{-5})/°C.](56° C.) = 0.26\%$$

Since Young Modulus (M)=stress/strain= /ϵor Tension Force=($M_\epsilon$) (l) (2)

where l is the thickness of the substrate=0.003 inch M of PET in WD is $5.9\times10^5$ lb/in$^2$ and in TD is $6.5\times10^5$ lb/in$^2$ Using equation (2)

Tension force per inch *PET* width required for stretching in the *WD* is $$F_{WD} = (5.9 \times 10^5 \text{ lb/in}^2)(0.0024)(0.003 \text{ inch})(1 \text{ inch}) = 4.3 \text{ lb}$$

Tension Force per inch *PET* width required for stretching in the *TD* is $$F_{TD} = (6.5 \times 10^5 \text{ lb/in}^2)(0.0026)(0.003 \text{ inch})(1 \text{ inch}) = 5.1 \text{ lb}$$

This test sample set up was then heated to 90° C. ($T_g$ of the charge transport layer was 81° C.) for about one minute and allowed to cool down to ambient room temperature. This temperature was below the $T_g$ of the substrate. A photoreceptor free of curls was obtained upon removal of the applied weights. In summary, biaxial stretching of the substrate to 0.24% strain in the WD and 0.26 percent strain in the TD as well as elevating the photoreceptor sample temperature to 90° C. (Tg of charge transport layer was 81° C.), photoreceptor curling was eliminated when the test sample was cooled to room ambient and the applied tension force removed. Since stretching the PET substrate to 0.24 percent and 0.26 percent strains, in the web and transverse directions, respectively, was below the elastic limit of the substrate, the substrate retracted to its original dimensions upon removal of the applied strain. Since this retraction by elastic recovery precisely compensated for the thermal dimensional mismatch between the charge transport layer and the substrate in the photoreceptor, a curl-free device was thus obtained.

EXAMPLE V

The photoconductive imaging members of Examples II through IV were evaluated for adhesion by 180° peel measurements to deterimine the bond strengths of the coating layers. The adhesion measurement methods employed for this purpose were 180° normal and reversed peel measurements. An Instron Tensile Tester, Model TM was used for the evaluation. The normal peel measurement for the photoconductive imaging members was designed to determine the CTL/generating layer adhesion strength and involved the following steps:

a) Prepare a 1 inch by 1/16 inch by 3 inch (2.54 cm×0.16 cm×7.62 cm) aluminum (Al) backing plate.
b) Place a double sided adhesive tape over the Al backing plate to facilitate test sample mounting. For successful peel measurement, the selected double sided tape should have a 180° adhesive peel strength of at least 900 gm/cm with both the Al plate and with the photoreceptor test sample.
c) Cut three test samples of 0.5 inch×6 inch (1.27 cm×15.24 cm), one near the center and each 1 inch (2.54 cm) from the edges across the width of the imaging member. For each test sample, split the CTL with a razor blade and then strip the layer by hand to approximately 3.5 inches (9 cm).
d) For the CTL peel measurement, press the test sample with the back side against a double sided tape/Al backing plate.
e) Insert the test sample with the Al backing plate into the jaws of the Instron Tensile Tester and it is ready for 180° normal tape peel measurement.
f) Set the load range of the Instron chart recorder at 200 grams full scale for the CTL peel measurement. With the jaw crosshead speed at 1 inch/min (2.54 cm/min) and the chart speed at 2 inches/min (5.08 cm/min), peel the CTL at least 2 inches (5.08 cm).

The reversed peel measurement was carried out to determine the efficacy of the adhesive characteristics of the adhesive interface layer. The stepwise procedures for the 180° reversed peel measurement are described as follows:

a) Cut three test samples of 0.5 inch×6 inch (1.27 cm×15.24 cm), one near the center and each 1 inch (2.54 cm) from the edges across the width of the imaging member. For each test sample, split the CTL with a razor blade and then initiate peel of the CTL layer by hand to approximately 3.5 inches (9 cm).
b) For the reversed peel measurement, press the CTL side of the test sample with the initiated CTL peel strip against the double sided tape/Al backing plate. Ensure that the lower edge of the CTL is positioned evenly with the bottom of the plate.
c) Insert the test sample with the Al backing plate into the jaws of the Instron Tensile Tester and it is ready for 180° reversed peel measurement.
d) Set the load range of the Instron chart recorder at 10 grams full scale for reversed peel measurement. With the jaw crosshead speed at 1 inch/min (2.54 cm/min) and the chart speed at 2 inches/min (5.08 cm/min), peel the PET substrate at least 2 inches (5.08 cm).

Both the 180° normal and reversed peel strengths of each imaging sample were calculated using the equation given below and the results obtained were tabulated in Table I.

ADHESN=L/W, gm/cm where: ADHESN=180° peel strength, gm/cm
L=average load, gm
W=Width of the test sample, cm

TABLE I

| Example | 180° Peel Strength (gm/cm) Normal | Reversed |
|---|---|---|
| II Std Control | 95 | 5.8 |
| III | 118 | 8.9 |

TABLE I-continued

| Example | 180° Peel Strength (gm/cm) Normal | Reversed |
|---|---|---|
| IV | 123 | 9.5 |

These data indicate that the adhesion strengths of the coating layers of the photoconductive imaging members for both curl-free imaging samples, either using a supporting substrate which closely matches the thermal contraction coefficient of the CTL for photoconductive imaging menber fabrication or employing the present invention of biaxial substrate stretching to compensate thermal contraction mismatch between the substrate and CTL, were significantly enhanced. The key to the observed adhesion enhancement was the total elimination of the internal stress build-up from the coating layer of the imaging member as reflected by the flat configuration of the final imaging member.

EXAMPLE VI

The photoconductive imaging members of Examples II and IV were cut to form a 2.54 cm×30.5 cm (1 inch by 12 inches) and tested for dynamic fatique CTL cracking resistance. Testing was effected by means of a dynamic mechanical cycling device in which each imaging sample was flexed over idler rolls to simulate photoconductive imaging member belt machine conditions. More specifically, one end of an imaging test sample was clamped to a stationary post and the sample was looped upwardly over three equally spaced horizontal idler rolls and then downwardly to form a generally inverted "U" shaped path with the free end of the sample attached to a 1 pound weight to provide a one pound per inch sample width tension. The face of the test sample bearing the CTL faced upwardly such that it was subjected to the maximum induced bending stress as the sample was flexed over the idler rolls. Each idler roll had a diameter of 19 mm (¾ inch) and was attached at each end to an adjacent verical surface of a pair of disks that were rotatable, by means of an electric motor, about a shaft connecting the centers of the disks. The three idler rolls were parallel to and equidistant from each other. The idler rolls were also equidistant from the shaft connecting the centers of the disk.

Although the disks were rotated about the shaft, each idler roll was secured to the disks and freely rotated around each individual roll axis. Thus, as the disks rotated about the shaft, two idler rolls were maintained at all times in contact with the back surface of the test sample. The axis of each idler roll was positioned about 4 cm from the shaft. The direction of movement of the idler rolls along the back surface of the test sample was away from the weighted end of the test sample and toward the end that clamped to the stationary post. Since there were three idler rolls in the test device, each complete rotation of th disks was equivalent to three bending flexes. The rotation of the spinning disks was adjusted to provide the equivalent of 28.7 cm (11.3 inches) per second tangent speed. The appearance of dynamic fatigue cracking of the CTL was examined at intervals of 10,000 flexes using a relflection optical microscope at 100× magnification.

The results of dynamic fatigue CTL cracking listed in Table II below show that the CTL cracking resistance of the curl-free photoconductive imaging sample of the present invention was improved by about 2.2 times over the standard control photoconductive imaging sample. The greatly superior CTL cracking resistance results achieved with the curl-free imaging sample of this invention is believed to be due to the combined effects of the removal of internal stress in the CTL and the decrease in bending stress as a result of reduction in the imaging sample thickness without the need of an anti-curl layer.

TABLE II

| Example | Fatique CTL Cracking (Flexes) |
|---|---|
| II Stnd Control | 150,000 |
| IV | 330,000 |

EXAMPLE VII

The electrical properties of the photoconductive imaging members prepared according to Examples II and IV were tested at 21° C. and 40 percent relative humidity, using a xerogrphic scanner. 50,000 cycles of testing gave identical charge acceptance, dark decay rate, background and residual voltages, photoinduced discharge characteristics, and cycle-down for both photocoonductive imaging members. These identical results were achieved notwithstanding the fact that the photoconductive imaging member of this invention underwent a biaxial stretching/heat treatment process. When examined under 200× magnification using a reflection/transmission optical microscope, the photoconductive imaging member of this invention, i.e. the imaging member of Example IV, showed no evidence of CTL, generating layer, adhesive layer, or blocking layer cracking.

The photoconductive imaging members of Examples II and IV were print tested on a Xerox Model D Flat Plate Copier in which a negative charging scorotron deposited about a −800 volt surface potential. A Xerox #1 camera was used with 2.5 second incadescent lanp exposure. The resulting electrostatic latent images were developed with cascading Xerox 1065 toner. The developed toner images were transferred to paper and fused in an oven fuser. Examination of the prints showed that the copy quality of the photoconductive imaging member of this invention was equivalent to that observed for the standard control photoconductive imaging member. The absence of any crack-like print defects under microscopic examination confirmed that the substrate biaxial stretching/heat treatment process employed in fabricating the curl-free imaging members of this invention does not cause the coating layers to develop stress cracks.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A process for fabricating an electrostatographic imaging member comprising providing a flexible substrate comprising a solid thermoplastic polymer, forming an imaging layer coating comprising a film forming polymer on said substrate, heating said coating and said substrate, cooling said coating and said substrate, and applying sufficient biaxial tension to said substrate while said imaging layer coating and said substrate are at a temperature greater than said glass transition temperature of said imaging layer coating to balance substantially all dimensional thermal contraction mismatches between said substrate and said imaging layer coating during cooling of said imaging layer coating whereby said final hardened and cooled imaging layer coating and substrate are substantially free of stress and strain, maintaining said biaxial tension below the elastic limit of said substrate, and removing application of said biaxial tension to said substrate whereby said substrate elastically retracts to its original dimensions.

2. A process for fabricating an electrostatographic imaging member according to claim 1 including applying a plurality of coatings to said substrate and drying said coatings prior to removing said application of said biaxial tension to said substrate.

3. A process for fabricating an electrostatographic imaging member according to claim 2 wherein the last applied coating comprises less than about 0.5 percent by weight solvent based on the total weight of said last applied coating.

4. A process for fabricating an electrostatographic imaging member according to claim 2 wherein said last applied coating comprises less than about 0.1 percent by weight solvent based on the total weight of said last applied coating.

5. A process for fabricating an electrostatographic imaging member according to claim 2 wherein said last applied coating comprises less than about 0.05 percent by weight solvent based on the total weight of said last applied coating.

6. A process for fabricating an electrostatographic imaging member according to claim 1 including maintaining the rate of removal of said application of said biaxial tension to said substrate so that said biaxial tension is substantially the same in both directions.

7. A process for fabricating an electrostatographic imaging member according to claim 1 including gradually removing application of said biaxial tension to said substrate during said cooling.

8. A process for fabricating an electrostatographic imaging member according to claim 1 including removing application of said biaxial tension to said substrate after said drying and said cooling are substantially complete.

9. A process for fabricating an electrostatographic imaging member according to claim 8 including removing said tension in one direction prior to the removal of tension in the other direction.

10. A process for fabricating an electrostatographic imaging member according to claim 9 including removing tension transversely of said substrate prior to the removal of tension longitudinally of said substrate.

11. A process for fabricating an electrostatographic imaging member according to claim 1 including initiating removal of application of said biaxial tension to said substrate after said imaging layer coating has solidified.

12. A process for fabricating an electrostatographic imaging member according to claim 1 wherein said substrate is anisotropic and including applying said biaxial tension to said substrate at a tension force of at least about ±20 percent of a predetermined compensational tension force in each direction of said substrate.

13. A process for fabricating an electrostatographic imaging member according to claim 12 wherein said tension force applied to said substrate is about ±10 percent of said predetermined compensational tension force in each direction of said substrate.

14. A process for fabricating an electrostatographic imaging member according to claim 13 wherein said tension force applied to said substrate is about ±5 percent of said predetermined compensational tension force in each direction of said substrate.

15. A process for fabricating an electrostatographic imaging member according to claim 1 wherein said tension force applied to said substrate results in a strain of less than about 0.26 percent.

16. A process for fabricating an electrostatographic imaging member according to claim 1 including applying said biaxial tension to said substrate prior to applying said imaging layer coating.

17. A process for fabricating an electrostatographic imaging member according to claim 1 including applying said biaxial tension to said substrate while applying said imaging layer coating.

18. A process for fabricating an electrostatographic imaging member according to claim 1 wherein said solid thermoplastic polymer in said flexible substrate is an isotropic polymer.

19. A process for fabricating an electrostatographic imaging member according to claim 1 wherein said film forming polymer in said imaging layer coating is an isotropic polymer.

* * * * *